US005349626A

United States Patent [19]

Ujari et al.

[11] Patent Number: 5,349,626

[45] Date of Patent: Sep. 20, 1994

[54] X-RAY TUBE ANODE TARGET

[75] Inventors: Paul U. Ujari, Milwaukee; Thomas C. Tiearney, Waukesha, both of Wis.

[73] Assignee: General Electric Company, Milwaukee, Wis.

[21] Appl. No.: 962,562

[22] Filed: Oct. 19, 1992

[51] Int. Cl.[5] ..... H01J 35/10

[52] U.S. Cl. ..... 378/144; 378/143

[58] Field of Search ..... 378/144, 143

[56] References Cited

U.S. PATENT DOCUMENTS 4,227,112 10/1980 Waugh et al. ..... 378/144

*Primary Examiner*—Craig E. Church

*Attorney, Agent, or Firm*—James J. Lichiello; John H. Pilarski

[57] ABSTRACT

A rotating anode target for X-ray devices comprises a circular graphite disc structure both of whose front and back sides or faces taper equally towards each other and define a narrow rim surface and central hub section. A larger area of the front face is coated with a focal track metal which extends coextensively over the front face to overlap part of the rim surface. The slant height dimension of the focal track metal is greater than the diameter of the hub section.

1 Claim, 1 Drawing Sheet

X-RAY TUBE ANODE TARGET

BACKGROUND OF THE INVENTION

This invention relates to X-ray beam generation devices and more particularly to an improved electron beam target for such devices.

Ordinarily, an X-ray beam generating device, referred to as an X-ray tube, comprises dual electrodes of an electric circuit in an evacuated chamber or tube. One of the electrodes is a cathode electrode and thermionic emitter which is mounted in the tube in spaced apart relationship to a target or anode electrode. The cathode is electrically heated to generate a stream or beam of electrons directed towards the target anode. The electron beam is appropriately focussed as a thin beam of very high velocity electrons striking the target. The target utilizes a striking surface of predetermined material (usually a refractory metal) and a particular geometric shape so that the kinetic energy of the striking electrons against the target material is converted to electromagnetic waves of very high frequency, i.e., X-rays, which emanate from the target to be collimated and focussed for penetration into an object for examination purposes.

Well known primary refractory metals for the target surface area exposed to the impinging electron beam include tungsten and molybdenum and their alloys for improved X-ray generation. In addition, the high velocity beam of electrons impinging the target generates extremely high and localized temperatures together with very high internal stresses leading to deterioration of the target, particularly targets of a composite structure. As a consequence, it has become a practice to utilize a rotating target assembly generally comprising a shaft supported disc-like structure having a concentric annular band of the target metal thereon which is impinged by the electron beam. Ordinarily this annular band is positioned concentrically with the target disc structure and adjacent to its rim periphery with a radial or band thickness significantly less than the inner diameter of the described annular band. The annular band is referred to as the focal track of the impinging electron beam. By means of a rotating target, the impinged region of the target is continuously changing to avoid localized heat concentration and to better distribute the heating effects throughout the target structure. Heating of the target by the impinging electrons is a major problem in X-ray target structures and tends to severely increase stress cracking and general target deterioration. In a high rotational speed target, heating must be kept within certain proscribed limits to reduce thermal stresses in composite target structures as well as to protect low friction high precision bearings which support the target. In the enclosed and evacuated environment of an X-ray tube, a target structure must have a high heat storage capacity since most heat transfer from the rotating target takes place through radiation from the target to the tube or envelope structure. Ordinarily only about 1.0% of the energy of the impinging electrons is converted into X-rays with the remainder converted into heat which must be dissipated from the target. The practice of rotating targets has progressed to target rotational speeds in excess of 10,000 rpm. At such elevated speeds it becomes quite important that a rotating target composite structure with its refractory metal surfaces have intrinsic resistance to high centrifugal forces and elevated temperature in excess of 1200°C. which exacerbate smaller defects for progressive breakdown and target failure.

OBJECTS OF THE INVENTION

It is a principal object of this invention to provide a structurally improved rotating target structure for X-ray generating devices.

It is another object of this invention to provide an improved heat resistant rotating target for X-ray generating devices.

It is a further object of this invention to provide a rotating X-ray target structure with an advantageous focal track for X-ray generation.

It is a still further object of this invention to provide an improved high speed, high temperature, composite X-ray target structure.

SUMMARY OF THE INVENTION

This invention discloses a rotating X-ray target structure in the form of a disc-like target with opposite front and back face surfaces both of which equally taper from a thicker hub portion to a narrow or reduced rim periphery. The tapered front surface is coextensively covered from hub to rim with a metallic layer to define an annular focal track with a slant height greater than the inner diameter of the focal track.

This invention will be better understood when taken in connection with the following drawings and description of the invention.

DESCRIPTION OF A PREFERRED EMBODIMENT

Figure 1:
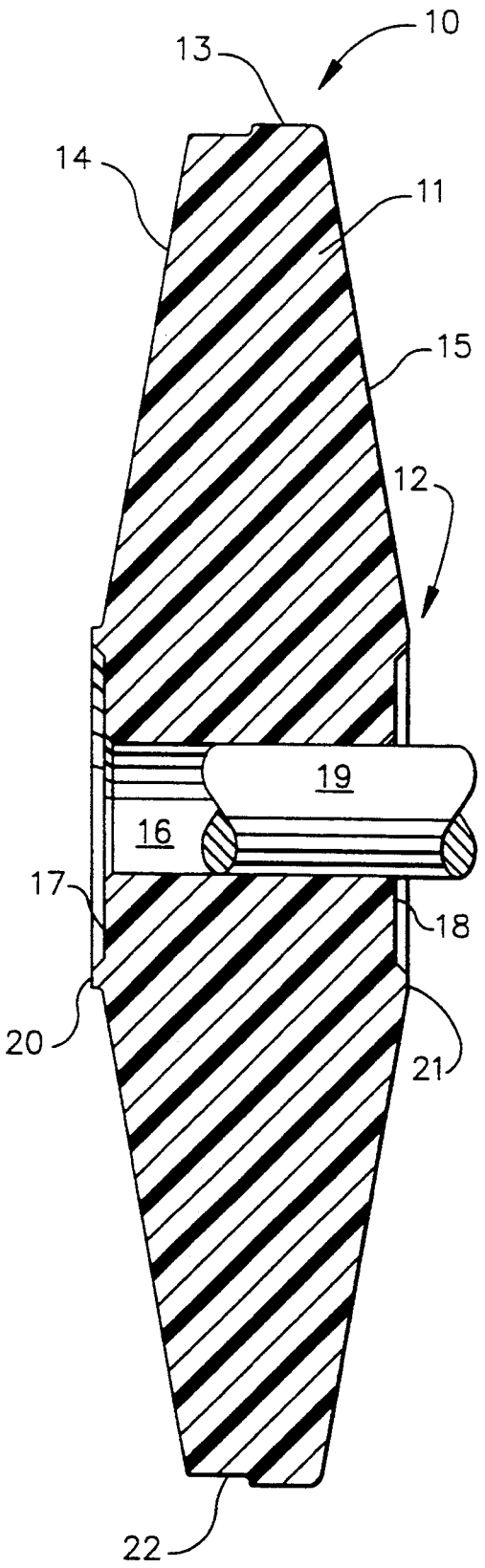
FIG. 1 is an elevational cross-sectional view of an X-ray rotating target substrate structure of this invention.

Referring now to FIG. 1, a rotating target substrate 10 comprises a circular disc-like body 11 of a high temperature resistant, relatively low mass, high heat conductivity material, which may include, for example, carbon-carbon composites, metal matrix composites, silicon carbide, and graphite. The geometric symmetry of body 11 is an important feature of this invention. For example, body 11 comprises a central circular and axially thicker section 12 smoothly joining with a narrow and axially thinner rim surface 13. More specifically, geometric symmetry of body 11 includes annular concentric tapered or bevelled front and back faces 14 and 15 which taper or slant towards each other from central section 12 to define the narrow axial rim periphery surface 13. The described annular faces 14 and 15 taper towards each other equally to provide geometric symmetry to body 11. An angle of taper of about 10° from a plane of the rotor parallel to and adjacent central section 12 and perpendicular to its central axis of revolution has been favorably employed in a practice of this invention. Circular central section 12 includes a coaxial bore 16, together with insets or counterbores 17 and 18, into which a target supporting shaft 19 is appropriately inserted and bonded or otherwise attached to body 11. Body 11 is also formed or produced with a small but distinct projecting circular and concentric ridge 20 on its front surface which, as illustrated in FIG. 1, is slightly exaggerated for the purpose of clarity and description. Projecting ridge 20 joins tapered face 14 with a small radius of curvature of about 0.25 mm. to avoid any discontinuities in a smooth surface extending from ridge 20 to the rim periphery 13. A corresponding projection in the form of a smooth shoulder 21 is formed on the back face of body 11. Projecting ridge 20 and corresponding shoulder 21 are circular transition borders or boundaries between the tapered faces 14 and 15 and the non-tapered circular central section or hub part 12 while also delineating hub part 12. Central section or hub part 12 ordinarily comprises the circular area between the axis of bore 16 and the commencement of the taper faces 14 and 15 at circular ridge 20 and shoulder 21, respectively. The use of a corresponding projecting ridge and shoulder continues the desirable geometric symmetry of the target substrate 10 of this invention. In addition, axial rim surface 13 includes an undercut part or recess 22 extending axially along its surface from front face 14 towards back face 15 and about half the distance therebetween at the surface of rim 13. The illustrated configuration of body 11 also facilitates bonding attachment and bordering of a target metal layer thereon. In this connection, front face 14 of body 11 between ridge 20 and rim recess 22 inclusive, is coated or covered with a target metal layer where ridge 20 provides a securely bonded inner border and recess 22 a securely bonded outer border. Such a metal layer is best described with respect to FIG. 2.

Figure 2:
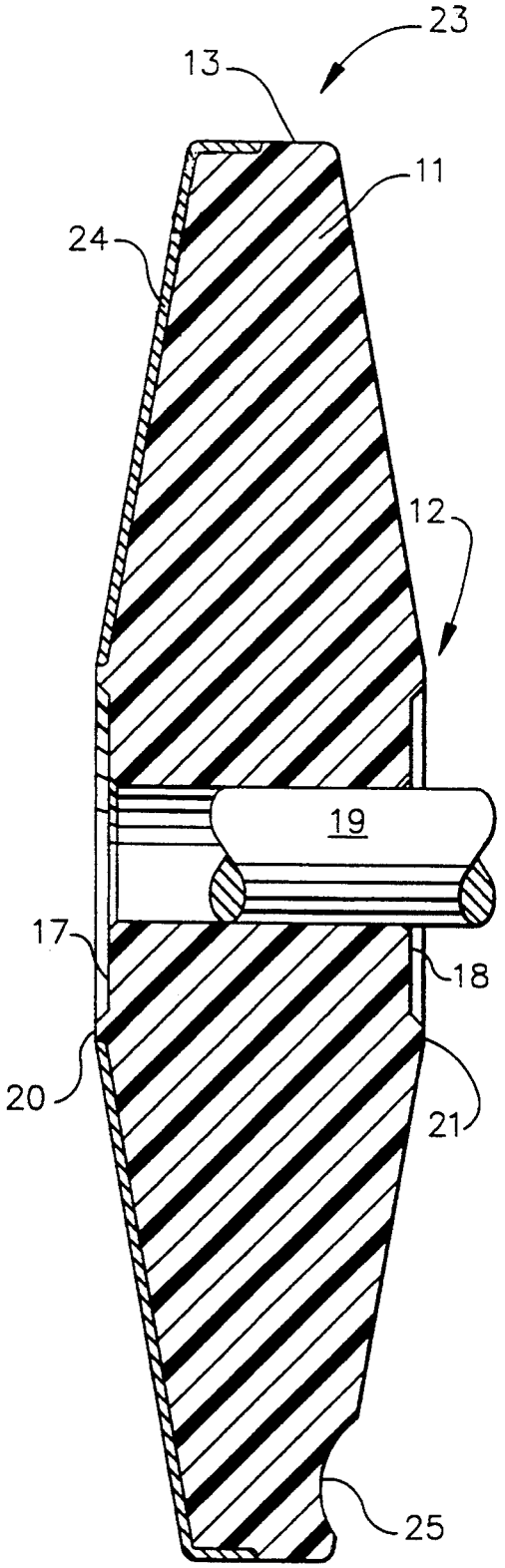
FIG. 2 is an elevational cross-sectional view of an X-ray composite structure rotating target of this invention.

Referring now to FIG. 2, composite target 23 includes the substrate 10 of FIG. 1 which, in one preferred form of this invention, is a high grade graphite which has been high temperature vacuum fired and carefully machined to be without nicks, scratches or chips. Composite target 23 utilizes the substrate 10 of FIG. 1 which has its front tapered face 14 coextensively covered with an annular layer of a focal track metal. Metals selected for layer 24 are those of higher atomic weight in the Periodic Table of Elements and more specifically, those known as refractory metals such as molybdenum (No), tantalum (Ta), tungsten (W), and rhenium (Re). Focal track layer 24 is expeditiously provided by chemical vapor deposition or other appropriate metal layer forming processes. Chemical vapor deposition of layer 24 may be preceded by the use of an additional sub-surface on body 11 of a layer of another material, used, for example, for improved bonding of metal layer 24 to graphite body 11. In one example of this Invention, metal layer 24 comprised a tungsten (97%)-rhenium (3%), alloy with a thickness of about 900 microns covering the annular area between ridge 20 and undercut 22 inclusive. A typical diameter of circular ridge 20 and its corresponding annular shoulder 20 is about 1.5 inches (38.1 min.) compared to an overall target diameter of about 5.225 inches (132.7 min.). In this connection, and as can be seen in FIG. 2, the radial thickness of the focal track annulus 24 along its tapered surface, i.e., slant height, is greater than the diameter of the hub part 12, i.e. greater than the inner diameter of the annular focal track 24. This ratio provides a more advantageous and larger track for rotary targets of this invention. The rim extension or overlap of coextensive metal layer 24 is smoothly received in undercut 22 and provides better bonding of layer 24 and increased resistance to separation under elevated temperatures and high centrifugal forces. Similarly layer 24 fits smoothly into the defined small radius at the juncture of ridge 20 and tapered front face 14 without any sharp discontinuity for an overall smooth metal surface extending from ridge 20 to undercut 22 inclusive. This larger focal track area is advantageous in preserving structural integrity of target layer 24 under high speed high temperature conditions, and particularly advantageous where the focal track material is a thin metal layer provided by the known CVD process (Chemical Vapor Deposition). A small and progressive crack in target layer 24 is faced with a much longer and more tortuous path before reaching potential breakdown conditions of the track or its target structure.

The use of a dual equally beveled face rotating target structure with one beveled face coextensively covered with a rim overlapping focal track material provides reduced centrifugal stresses, superior heat absorption characteristics and structural integrity. Speed tests show the rotary target of this invention operating at speeds of 18,000 rpm without structural failure. The focal track of the target of this invention covers most of the front surface exposed to electron beam impingement to generate a fuller production of X-rays with increased heat absorption and dissipation. High speed rotation with increased area focal track and high heat absorption permits target operation at higher electrical power input.

Because of the high speed rotation of rotating X-ray targets, it is important that their dynamic balance be quite accurate and random removal of material from the substrate graphite body be avoided. For this reason, a predetermined region of the graphite body 11 of this invention is proscribed. As illustrated in FIG. 2, a spherical indentation 25 is located in the back face of body 11 closely adjacent the rim periphery 13. In one practice indentation 25 was produced with a 0.512 inch (13.0 mm.) diameter ball end mill for graphite removal purposes. The edge of indentation 25 next adjacent rim 13 should be spaced no closer than about 2.54 mm. from rim 13. Graphite removal at this region 25 with limited depth, e.g., a maximum of about 3.0 mm., minimizes weakening of the target under high centrifugal forces.

This invention provides a high speed rotating X-ray target structure of geometric symmetry with dual equally tapered faces and a larger CVD annular focal track on one of the faces. The radial thickness of the annular track is greater than the inner diameter of the annular track.

While this invention has been disclosed and described with respect to preferred embodiments, it will be understood that various changes and modifications may be made without departing from the spirit and scope of the invention in the following claims.

What is claimed:

1. A rotating X-ray composite target structure comprising, in combination (a) a circular graphite disc body having opposed front and back face surfaces, (b) each of said surfaces having a large annular section tapering towards each other to define a narrow axial rim periphery surface and a central circular hub section, (c) a circular concentric ridge projecting from said front surface by a small radius of curvature and defining said hub section from which said face surfaces taper towards each other at about 10°, (d) a circular concentric smooth shoulder at said back surface corresponding to said ridge on said front surface and defining said hub section from which said back face tapers towards said front face, (e) said axial, rim surface having an undercut portion therein extending a significant dimension from said front face towards said back face, (f) and a layer of a refractory metal alloy coextensively covering said tapered front face to fit smoothly into said small radius of curvature of said ridge at said defined hub and smoothly into said axial rim surface undercut portion, g) the slant height thickness of said layer being greater than the diameter of said hub section.

* * * * *